US010612448B2

(12) United States Patent
Tabata et al.

(10) Patent No.: US 10,612,448 B2
(45) Date of Patent: Apr. 7, 2020

(54) COOLING STRUCTURE OF MULTI-CYLINDER ENGINE

(71) Applicant: Mazda Motor Corporation, Aki-gun, Hiroshima (JP)

(72) Inventors: Daisuke Tabata, Hiroshima (JP); Hiroaki Muranaka, Higashihiroshima (JP); Daisuke Matsumoto, Hiroshima (JP); Masaki Takahara, Hiroshima (JP)

(73) Assignee: Mazda Motor Corporation, Aki-gun, Hiroshima (JP)

( * ) Notice: Subject to any disclaimer, the term of this patent is extended or adjusted under 35 U.S.C. 154(b) by 0 days.

(21) Appl. No.: 16/128,791

(22) Filed: Sep. 12, 2018

(65) Prior Publication Data

US 2019/0112963 A1 Apr. 18, 2019

(30) Foreign Application Priority Data

Oct. 13, 2017 (JP) ..... 2017-198992

(51) Int. Cl.

| | |
|---|---|
| ***F02B 75/18*** | (2006.01) |
| ***F01P 3/02*** | (2006.01) |
| ***F02F 1/14*** | (2006.01) |
| ***F02F 1/10*** | (2006.01) |

(52) U.S. Cl.

CPC ..... *F01P 3/02* (2013.01); *F02F 1/10* (2013.01); *F02F 1/14* (2013.01); *F01P 2003/021* (2013.01)

(58) Field of Classification Search

CPC ..... F02F 1/14; F01P 3/02; F01P 2003/021

USPC ..... 123/41.74

See application file for complete search history.

(56) References Cited

U.S. PATENT DOCUMENTS

| | | | | |
|---|---|---|---|---|
| 9,470,176 | B2 * | 10/2016 | Beyer | F02F 1/16 |
| 9,670,822 | B2 * | 6/2017 | Beyer | F01P 3/02 |
| 2005/0217615 | A1 * | 10/2005 | Matsutani | F01P 3/02 123/41.74 |

(Continued)

FOREIGN PATENT DOCUMENTS

| | | | |
|---|---|---|---|
| EP | 3168449 | A1 | 5/2017 |
| JP | 2015078675 | A | 4/2015 |

(Continued)

*Primary Examiner* — Long T Tran

*Assistant Examiner* — James J Kim

(74) *Attorney, Agent, or Firm* — Alleman Hall Creasman & Tuttle LLP

(57) ABSTRACT

A cooling structure of a multi-cylinder engine is provided, which includes cylinder bores formed in a cylinder block, a water jacket surrounding the bores, a cylinder head, and a water jacket spacer accommodated in the water jacket and having a peripheral wall formed corresponding to the cylinder bores. A length of the peripheral wall in cylinder bore axial directions is substantially the same as that of the water jacket. The peripheral wall forms, inside the water jacket, inner and outer channels, and a width of the inner channel is less than that of the outer channel. Communicating holes communicating the inner and outer channels are formed in the peripheral wall at locations between adjacent cylinder bores, respectively. Inter-bore channels into which some cooling fluid flowing from the outer channel into the inner channel flows are provided to parts of the cylinder block between the adjacent cylinder bores, respectively.

4 Claims, 15 Drawing Sheets

(56) References Cited

U.S. PATENT DOCUMENTS

| | | | | |
|---|---|---|---|---|
| 2010/0242868 | A1* | 9/2010 | Shikida | F01P 3/02<br>123/41.79 |
| 2012/0132157 | A1* | 5/2012 | Matsuki | F02F 1/14<br>123/41.79 |
| 2015/0159540 | A1* | 6/2015 | Misumi | F02F 1/16<br>123/41.44 |
| 2017/0298860 | A1* | 10/2017 | Mori | F01P 3/02 |

FOREIGN PATENT DOCUMENTS

| | | | |
|---|---|---|---|
| JP | 2015083791 | A | 4/2015 |
| JP | 201789563 | A | 5/2017 |

* cited by examiner

COOLING STRUCTURE OF MULTI-CYLINDER ENGINE

TECHNICAL FIELD

The present disclosure belongs to a technical field related to a cooling structure of a multi-cylinder engine.

BACKGROUND OF THE DISCLOSURE

Conventionally, as a cooling structure of a multi-cylinder engine, for example, a structure is known in which a water jacket is formed in a cylinder block so as to surround the perimeter of a plurality of cylinder bores (a plurality of cylinder bore walls) and cooling fluid pumped by a water pump is introduced into the water jacket to cool an engine.

Moreover, as disclosed in JP2017-089563A, a structure is known in which an inter-bore channel is provided to a part of a cylinder block (cylinder bore wall) between adjacent cylinder bores to allow cooling fluid in the water jacket to flow into a cylinder head to cool the part between the cylinder bores which tends to be at a high temperature. In JP2017-089563A, in order to allow a sufficient quantity of cooling fluid to flow through the inter-bore channel, a guide part is formed in a water jacket spacer accommodated in the water jacket of the cylinder block to lead the cooling fluid into an inlet of the inter-bore channel.

Meanwhile, in compression-ignition engines including diesel engines, it is necessary to keep combustion chambers of the engine warm in order to secure an environment for stabilizing compression ignition of fuel, i.e., in order to maintain the temperature of the combustion chambers at a temperature where compression ignition is possible. Further, it is necessary to cool the combustion chambers especially when the engine is operating at a high load.

The water jacket spacer of JP2017-089563A overlaps with an inner side-wall surface of the water jacket (an outer side surface of the cylinder bore wall), and therefore almost no gap can be formed between the water jacket spacer and the inner side-wall surface of the water jacket. Moreover, a part of the water jacket spacer on the cylinder head side only has the guide part and does not cover the cylinder bore wall. Thus, although the structure of JP2017-089563A can secure the cooling performance of the combustion chambers, it is difficult to secure the heat retention performance of the combustion chambers.

SUMMARY OF THE DISCLOSURE

The present disclosure is made in view of the situations described above, and it is to provide a cooling structure of a multi-cylinder engine, which achieves securing both cooling performance and heat retention performance of the combustion chambers.

In order to achieve the aforementioned purpose, according to one aspect of the present disclosure, a cooling structure of a multi-cylinder engine having a cylinder block is provided, which includes a plurality of cylinder bores formed in the cylinder block, a water jacket surrounding the plurality of cylinder bores, a cylinder head, and a water jacket spacer accommodated in the water jacket of the cylinder block and having a peripheral wall formed to correspond to the plurality of cylinder bores. A length of the peripheral wall in cylinder bore axial directions is substantially the same as a length of the water jacket in the cylinder bore axial directions. The peripheral wall forms, inside the water jacket, an inner channel located inside the peripheral wall and an outer channel located outside the peripheral wall. A width of the inner channel is less than a width of the outer channel. Communicating holes communicating the inner channel with the outer channel are formed in the peripheral wall at locations between adjacent cylinder bores, respectively. Inter-bore channels into which some of cooling fluid flowing from the outer channel into the inner channel through the communicating holes flows are provided to parts of the cylinder block between the adjacent cylinder bores, respectively.

According to this structure, since the length of the peripheral wall in the cylinder bore axial directions is substantially the same as the length of the water jacket in the cylinder bore axial directions, the inner channel and the outer channel are partitioned by the peripheral wall, thereby fundamentally communicating with each other only at the communicating holes. Further, when the cooling fluid is flowed into the water jacket from outside of the cylinder block, normally, the fluid is flowed into the outer channel which is located outside the peripheral wall. Although the cooling fluid may flow into both the outer and inner channels, since the width of the inner channel is less than the width of the outer channel, it is difficult for the cooling fluid to flow inside the inner channel. Thus, in the inner channel, it is difficult for fresh cooling fluid to flow and it is stagnated. Therefore, heat retention performance of the combustion chamber of the multi-cylinder engine can be secured by the cooling fluid in a stagnated state.

On the other hand, in the outer channel, the cooling fluid can be flowed vigorously, and some of the cooling fluid flows into the inner channel through the communicating holes and some of the cooling fluid which inflowed then flows into the inter-bore channels. Especially by making at least a part of an inner circumferential surface of each communicating hole incline toward an inlet of a corresponding one of the inter-bore channels, a large amount of the cooling fluid which flowed into the inner channel through the communicating holes from the outer channel can be flowed into the inter-bore channels. Therefore, the cooling performance of the combustion chamber of the multi-cylinder engine can be secured, and the majority of the cooling fluid in the inner channel can be maintained in the stagnated state.

Therefore, the cooling performance of the combustion chamber of the multi-cylinder engine can be secured, and the heat retention performance of the combustion chamber can be secured by the cooling fluid inside the inner channel.

At least a part of an inner circumferential surface of each communicating hole in the circumferential directions may incline toward an inlet of a corresponding one of the inter-bore channels.

According to this, a large amount of the cooling fluid which flowed into the inner channel through the communicating holes from the outer channel can be flowed into the inter-bore channels. Therefore, securing both the cooling performance and the heat retention performance of the combustion chamber of the multi-cylinder engine can easily be achieved.

A part of the inner circumferential surface of each communicating hole on a cylinder head side may incline toward the inlet of the corresponding inter-bore channel. A part of the inner circumferential surface of each communicating hole on an opposite side of the cylinder head may incline toward a location below the inlet of the corresponding inter-bore channel.

According to this, a large amount of the cooling fluid which flowed into the inner channel through the communicating holes from the outer channel can be flowed into the inter-bore channels, and a portion of the cooling fluid which flowed into the inner channel through the communicating holes can be assigned to the lower part of the inlets of the inter-bore channels in an outer side surface of a cylinder bore wall. As a result, the cylinder bore wall can also be cooled from the outer side surface.

A cooling fluid inlet communicating with the outer channel may be provided to the cylinder block, the cooling fluid flowing into the outer channel cooling fluid inlet.

According to this, the cooling fluid in the inner channel can be made into a more stagnated state. Further, the cooling fluid can be flowed vigorously from the outer channel to the inner channel through the communicating hole, and a large amount of the cooling fluid can be flowed into the inter-bore channel through the communicating hole.

The multi-cylinder engine may be an in-series multi-cylinder engine. The cooling fluid inlet may communicate with a part of the outer channel on a first side in cylinder line-up directions. The cooling fluid flowing into the outer channel from the cooling fluid inlet and flowing through the outer channel may flow along a route sequentially from the part of the outer channel on the first side, through a part on an exhaust side and a part on a second side in the cylinder line-up directions, and into a part on an intake side. A rib configured to disrupt the cooling fluid flowing in the circumferential directions in the part of the inner channel on the first side in the cylinder line-up directions may be formed in the part of an inner-channel-side surface of the peripheral wall on the first side.

According to this, the cooling fluid which did not flow into the inter-bore channels, of the cooling fluid which flowed into the inner channel through the communicating holes from the part of the outer channel on the exhaust side, does not flow toward the part formed with the rib in the inner channel, but instead flows to the second side in the cylinder line-up directions similar to the cooling fluid flowing in the outer channel on the exhaust side. As a result, the part of the cylinder bore wall on the exhaust side which gets particularly hot can be cooled over the large area in the circumferential directions, and the cooling performance of the combustion chamber of the multi-cylinder engine can further be secured. On the other hand, since the width of the inner channel is small as described above, the cooling fluid which did not flow into the inter-bore channels is difficult to spread in the cylinder bore axial directions of the inner channel, and basically, it flows toward the second side in the cylinder line-up directions at substantially the same location with the communicating holes in the cylinder bore axial directions. Therefore, the majority of the cooling fluid in the inner channel can be maintained in the stagnated state and the heat retention performance of the combustion chamber of the multi-cylinder engine can be secured.

DETAILED DESCRIPTION OF THE DISCLOSURE

Hereinafter, one embodiment of the present disclosure is described in detail with reference to the accompanying drawings.

Figure 1:
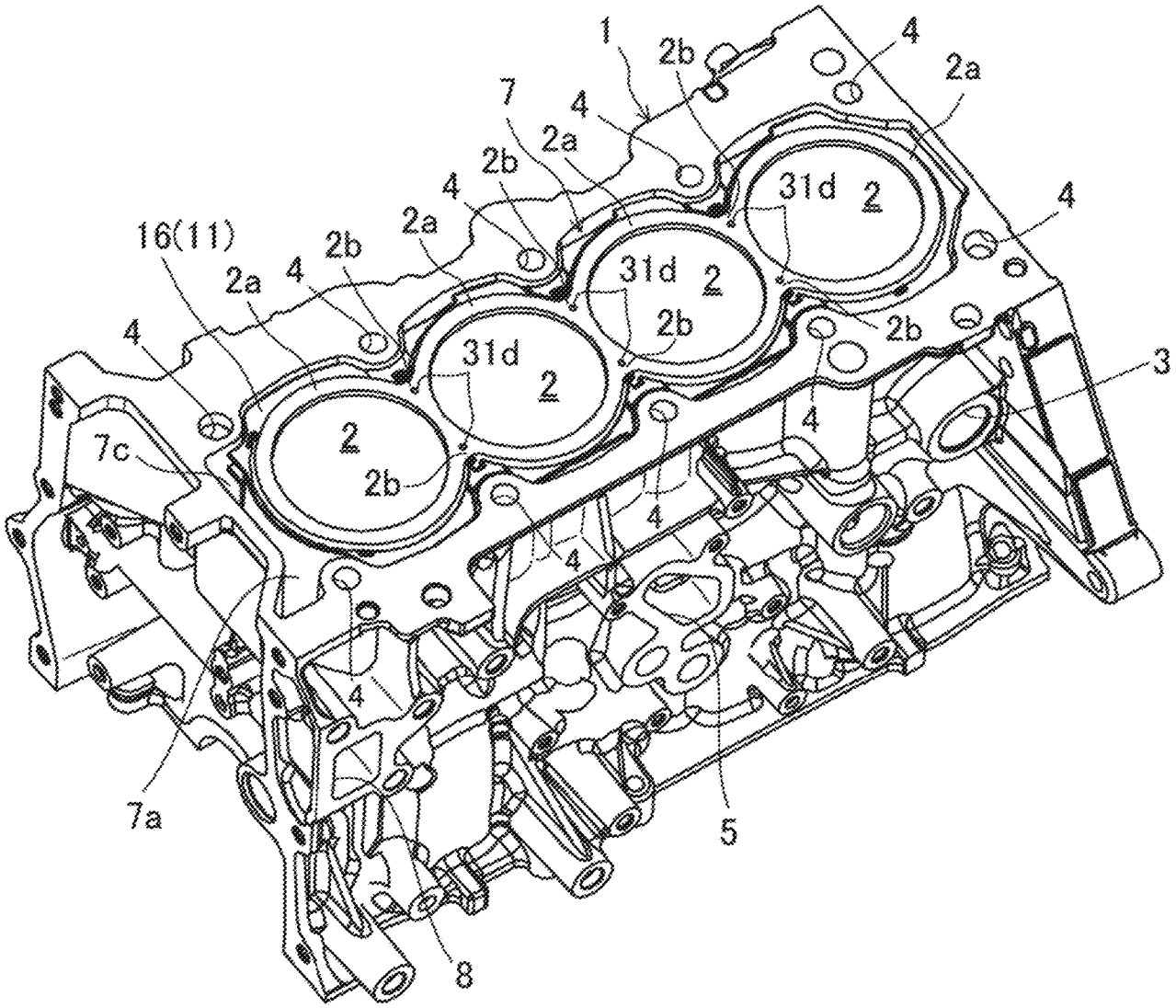
FIG. 1 is a perspective view illustrating a cylinder block of a multi-cylinder engine to which a cooling structure according to one embodiment of the present disclosure is applied in a state where a water jacket spacer is accommodated in a block water jacket.
Figure 2:
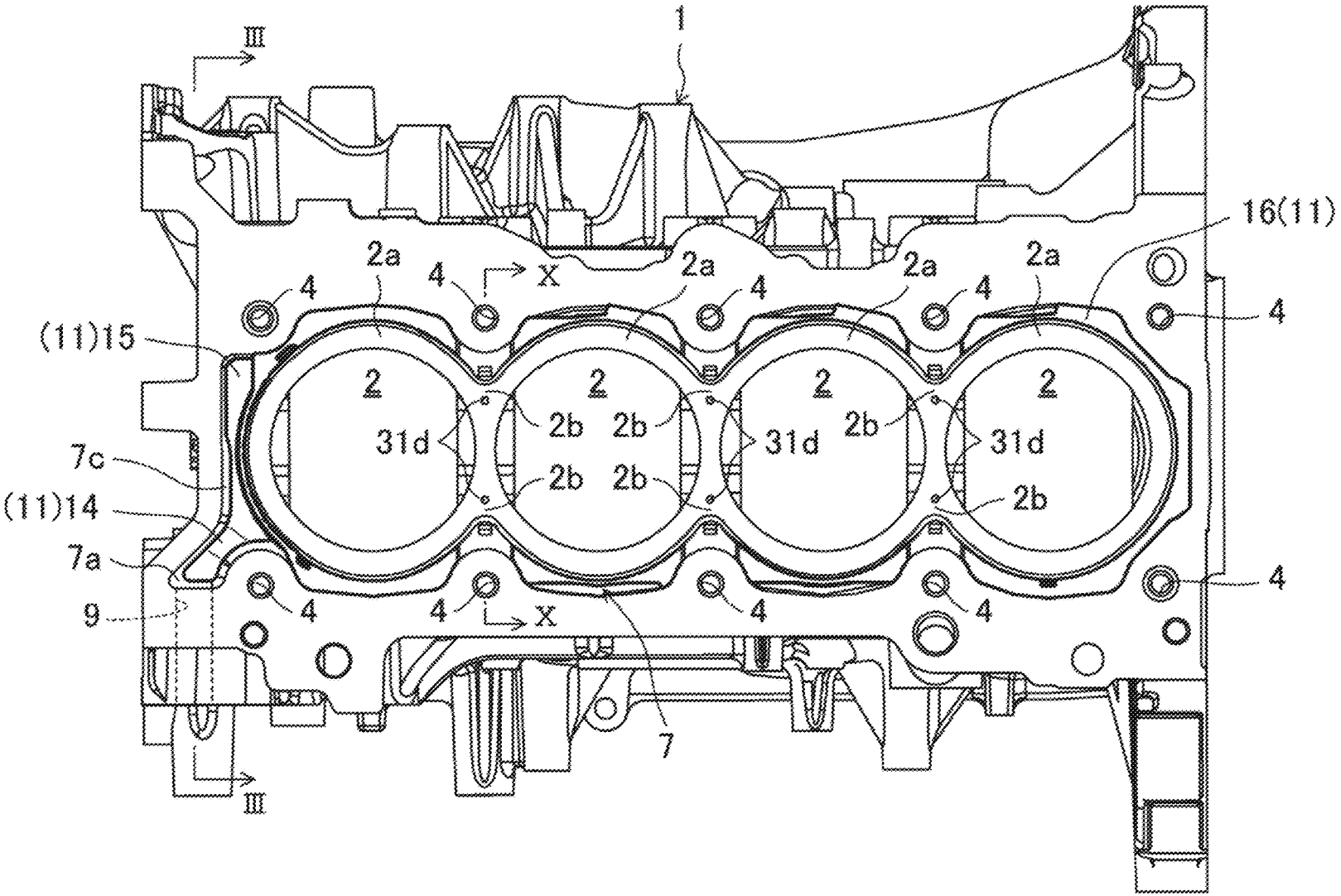
FIG. 2 is a plan view of the cylinder block of FIG. 1 in which the water jacket spacer is accommodated in the block water jacket.

FIGS. 1 and 2 illustrate a cylinder block 1 of a multi-cylinder engine to which a cooling structure according to one embodiment of the present disclosure is applied (hereinafter, simply referred to as "the engine"). In this embodiment, the engine is an in-line 4-cylinder diesel engine, having a cylinder block 1 provided with four cylinder bores 2 arranged in-line, and cylindrical-shaped cylinder bore walls 2*a* surrounding the perimeters of the cylinder bores 2, respectively. Adjacent cylinder bore walls 2*a* are integrally coupled to each other, and this type of cylinder block 1 is called a Siamese cylinder block. A part of the cylinder bore walls 2*a* between the adjacent cylinder bores 2 is narrowed.

In this embodiment, the engine is mounted in an engine bay located at a front part of a vehicle so that cylinder line-up directions are oriented in vehicle width directions and cylinder bore axial directions are oriented in vertical directions. A lower right side of FIG. 1 and a lower side of FIG. 2 correspond to an intake side through which intake air is introduced into the engine, and an upper left side of FIG. 1 and an upper side of FIG. 2 correspond to an exhaust side through which exhaust gas is discharged from the engine. A transmission (not illustrated) is attached to an end face of the cylinder block 1 on the left side of the vehicle (right side of FIG. 2). In the following description, the engine shall be in a state where it is mounted in the vehicle.

In this embodiment, a heater plug-in hole 3 into which a block heater (not illustrated) used in a cold region is inserted by a crew member is formed in a part in an intake-side surface of the cylinder block 1 on the transmission side.

Figure 10:
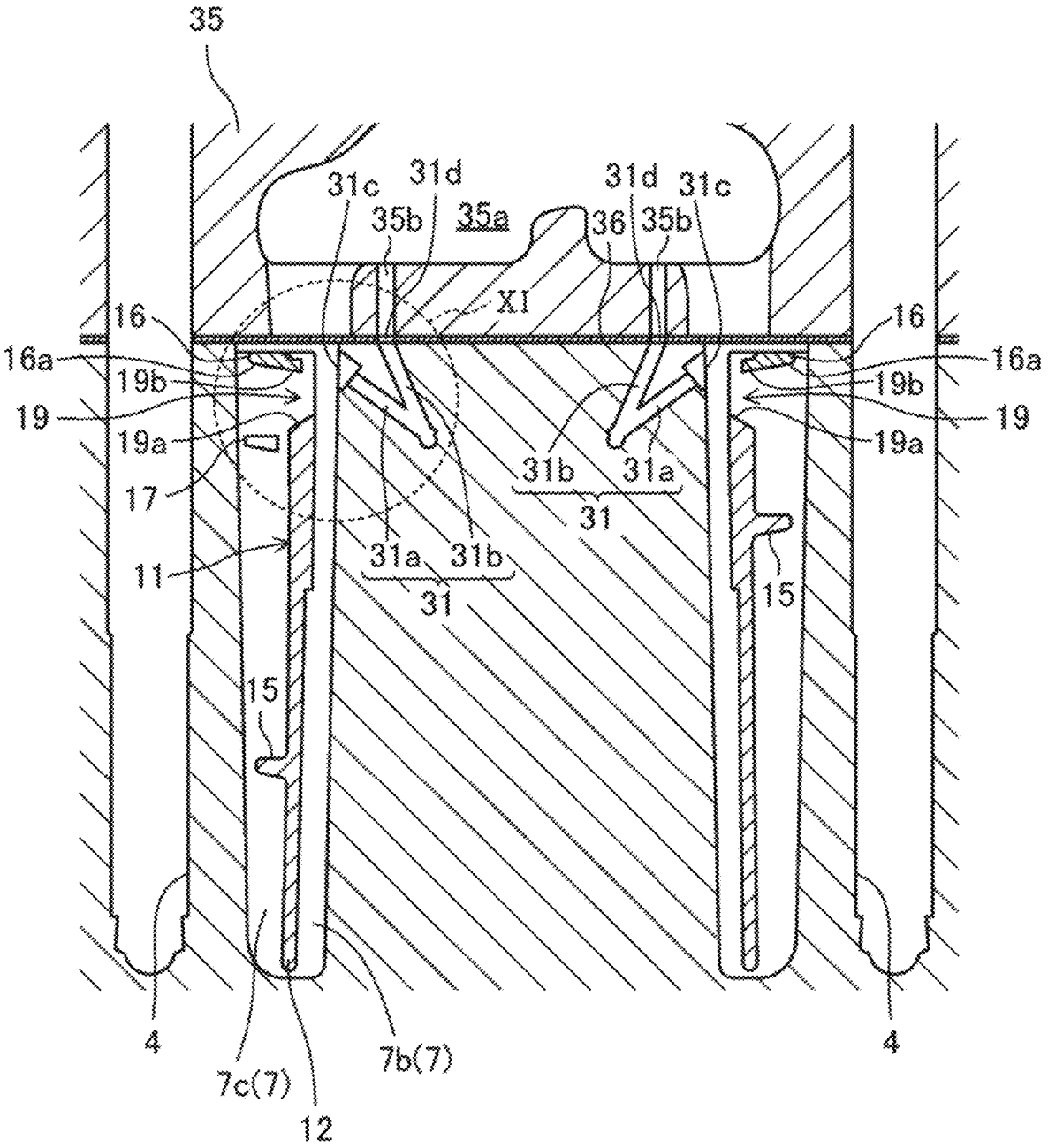
FIG. 10 is a cross-sectional view taken along a line X-X of FIG. 2.

As illustrated in FIG. 10, a cylinder head 35 is attached to an upper surface of the cylinder block 1 (i.e., a surface of the cylinder block 1 on a first side in the cylinder bore axial directions) through a gasket 36. Eight tapped holes 4 with which bolts (not illustrated) for attaching and fixing the cylinder head 35 to the cylinder block 1 threadedly engage are formed in the upper surface of the cylinder block 1.

The cylinder block 1 is provided with a block water jacket 7 which surrounds the perimeter of the four cylinder bores 2 (four cylinder bore walls 2*a*). The block water jacket 7 is formed in a deep groove shape so as to open in the upper surface of the cylinder block 1. This opening is closed by the gasket 36 when the cylinder head 35 is attached to the upper surface of the cylinder block 1 through the gasket 36.

A side wall inside the block water jacket 7 is comprised of the cylinder bore walls 2*a*. A side wall surface inside the block water jacket 7 is comprised of an outer side surface of the cylinder bore wall 2*a*. The block water jacket 7 is curved inwardly so as to be closer to an imaginary central plane including all the centerlines of the four cylinder bores 2, corresponding to intake and exhaust side parts of the cylinder bore walls 2*a* between adjacent cylinder bores 2. Below, each of the intake and exhaust side parts of the cylinder bore walls 2*a* between the adjacent cylinder bores 2 is referred to as a "necked part 2*b*." Therefore, in this embodiment, a total of six necked parts 2*b* are formed in the cylinder bore walls 2*a*.

The block water jacket 7 is provided, in a part thereof on the intake side and the opposite side of the transmission, with a cooling fluid introducing part 7*a* through which the cooling fluid is introduced into the block water jacket 7.

A cooling fluid inlet 8 through which the cooling fluid (e.g., engine cooling water) flows into the block water jacket 7 is provided in a part of the intake-side surface of the cylinder block 1 on the opposite side of the transmission. The cooling fluid inlet 8 communicates with the cooling fluid introducing part 7*a* through a communicating channel 9 (see FIG. 3) having a rectangular cross-sectional shape provided in the intake-side wall part of the cylinder block 1. Thus, the cooling fluid inlet 8 communicates with the block water jacket 7 (in detail, with an outer channel 7*c* described below). The cooling fluid inlet 8 is connected with a discharge port of a water pump (not illustrated). Thus, the cooling fluid discharged from the discharge port of the water pump is introduced into the cooling fluid introducing part 7*a* through the cooling fluid inlet 8 and the communicating channel 9, and then flows into the block water jacket 7 (in detail, the outer channel 7*c* described below) from the cooling fluid introducing part 7*a*.

Figure 3:
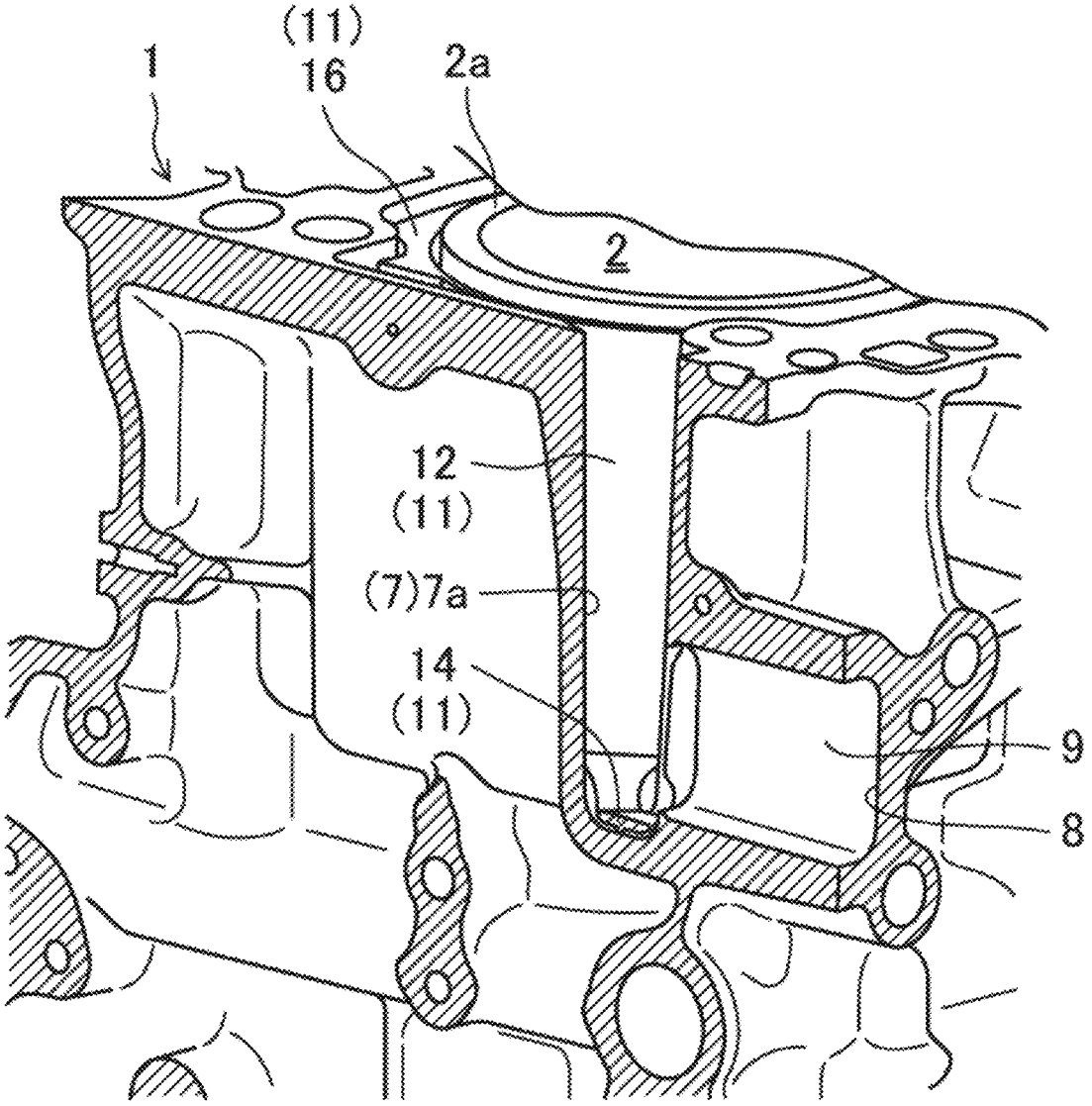
FIG. 3 is a cross-sectional perspective view taken along a line of FIG. 2.

As illustrated in FIG. 3, the communicating channel 9 opens in the outer side-wall surface of the block water jacket 7 (in detail, the side wall surface of the cooling fluid introducing part 7*a*). A lower surface of the opening is located higher than a bottom surface of the cooling fluid introducing part 7*a*, thereby producing a stepped part between the lower surface of the opening and the bottom surface of the cooling fluid introducing part 7*a*. The stepped part is produced because of a directional difference of removing molds between a mold for the communicating channel 9 (removed toward the cooling fluid inlet 8) and a mold for the block water jacket 7 (removed upwardly) when casting the cylinder block 1.

As illustrated in FIGS. 4 to 11, a water jacket spacer 11 having a peripheral wall 12 formed corresponding to the four cylinder bores 2 (four cylinder bore walls 2*a*) is accommodated in the block water jacket 7. The water jacket spacer 11 is made of resin. The height of the peripheral wall 12 (i.e., a length in the cylinder bore axial directions) is substantially the same as a groove depth of the block water jacket 7 (i.e., a length in the cylinder bore axial directions). In this embodiment, the peripheral wall 12 of the water jacket spacer 11 has cylindrical shapes surrounding the four cylinder bores 2 (four cylinder bore walls 2*a*). Note that the peripheral wall 12 may be partially separated or divided in circumferential directions.

The water jacket spacer 11 is constructed by the peripheral wall 12 of the water jacket spacer 11 so that an inner channel 7*b* located inside the peripheral wall 12 (on the cylinder bore wall 2*a* side) and an outer channel 7*c* located outside the peripheral wall 12 (on the opposite side from the cylinder bore wall 2*a*) are formed in the water jacket 7 (particularly, see FIG. 10). A width of the inner channel 7*b* (a distance between the inner surface of the peripheral wall 12 and the inner side-wall surface of the water jacket 7) is less than a width of the outer channel 7*c* (a distance between the outer surface of the peripheral wall 12 and the outer side-wall surface of the water jacket 7). The peripheral wall 12 of the water jacket spacer 11 has, similar to the water jacket 7, six inwardly bent parts 13 which curve inwardly so as to be closer to the central plane described above corresponding to the six necked parts 2*b* of the cylinder bore wall 2*a*, respectively.

An extended part 14 extending so as to cover the bottom surface of the cooling fluid introducing part 7*a* from above is provided in a part of a lower end part of the peripheral wall 12 of the water jacket spacer 11 corresponding to the cooling fluid introducing part 7*a*. An upper surface of the extended part 14 is located at the same height as the lower surface of the opening of the communicating channel 9 described above so that the stepped part described above is eliminated by the extended part 14. If the stepped part remains, this stepped part disrupts the flow of the cooling fluid introduced into the cooling fluid introducing part 7*a* from the communicating channel 9. On the other hand, by the extended part 14 eliminating the stepped part, the disruption of the cooling fluid flow is controlled.

Figure 4:
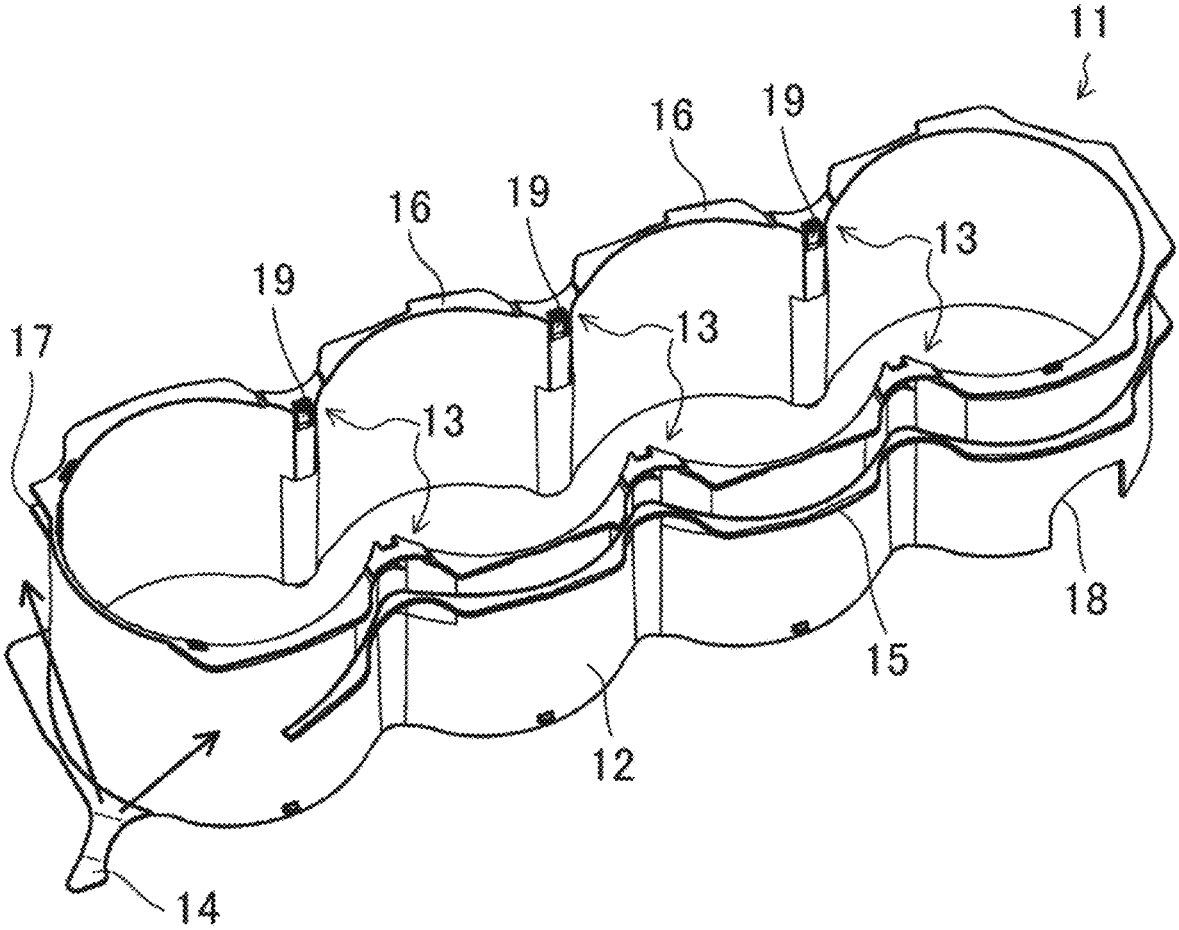
FIG. 4 is a perspective view illustrating the water jacket spacer.
Figure 5:
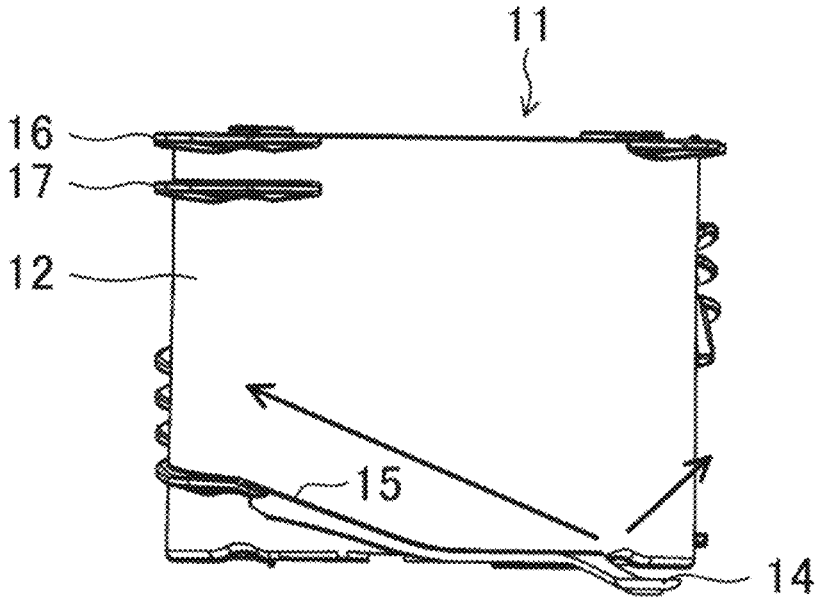
FIG. 5 is a view of the water jacket spacer when seen from the opposite side from a transmission.

The cooling fluid introducing part 7*a* extends, in the plan view, obliquely to the exhaust side toward the transmission. A downstream end of the cooling fluid introducing part 7*a* is connected to the part of the outer channel 7*c* on the opposite side of the transmission. Thus, the cooling fluid inlet 8 is a cooling fluid inlet into the outer channel 7*c*, and communicates with the part of the outer channel 7*c* on the opposite side of the transmission (a part on first side in the cylinder line-up directions). As illustrated in FIGS. 4 and 5, the inclination of the cooling fluid introducing part 7*a* described above causes a majority of the cooling fluid which flowed into the outer channel 7*c* from the cooling fluid introducing part 7*a* to flow to the exhaust side along the outer surface of the part of the peripheral wall 12 of the water jacket spacer 11 on the opposite side of the transmission. The remaining portion of the cooling fluid flows to the transmission side along the outer surface of the intake-side part of the peripheral wall 12 (see arrows in FIGS. 4 and 5).

Although illustration is omitted, an inflow hole, which the cooling fluid flows through a part of the outer channel 7*c* on the opposite side of the transmission flows into a head water jacket 35*a* (see FIG. 10) in the cylinder head 35, is formed in an end part of the cylinder head 35 and an end part of the gasket 36 on the opposite side of the transmission, respectively. The inflow holes of the cylinder head 35 and the gasket 36 are located above the part of the outer channel 7*c* on the opposite side of the transmission, and vertically communicate the outer channel 7*c* with the head water jacket 35*a*.

Since the cooling fluid immediately after flowing into the outer channel 7*c* from the cooling fluid introducing part 7*a* and then flowing to the exhaust side has just been discharged from the discharge port of the water pump, the flow is strong, thereby the cooling fluid flows strongly vertically upward. Thus, some of the cooling fluid which flows to the exhaust side passes through the inflow hole and then flows into an end part (on the opposite side of the transmission) of the head water jacket 35*a* which extends in the cylinder line-up directions. The cooling fluid which did not flow into the inflow hole flows inside the outer channel 7*c* through the part on the opposite side of the transmission, the part on the exhaust side, the part on the transmission side, and the part on the intake side in this order so that it substantially circles the outer channel 7*c* (see arrows in FIGS. 6 to 8). That is, the route of the cooling fluid which flows into the outer channel 7*c* from the cooling fluid inlet 8 and then flows through the outer channel 7*c* is fundamentally a route where the cooling fluid flows from the part of the outer channel 7*c* on the opposite side of the transmission (the part on the first side in the cylinder line-up directions described above), then passes through the part on the exhaust side and the part on the transmission side (the part on the second side in the cylinder line-up directions), then flows into the part on the intake side. The cooling fluid which flows through the outer channel 7*c* flows, in the plan view, in a substantially U-shape.

Figure 6:
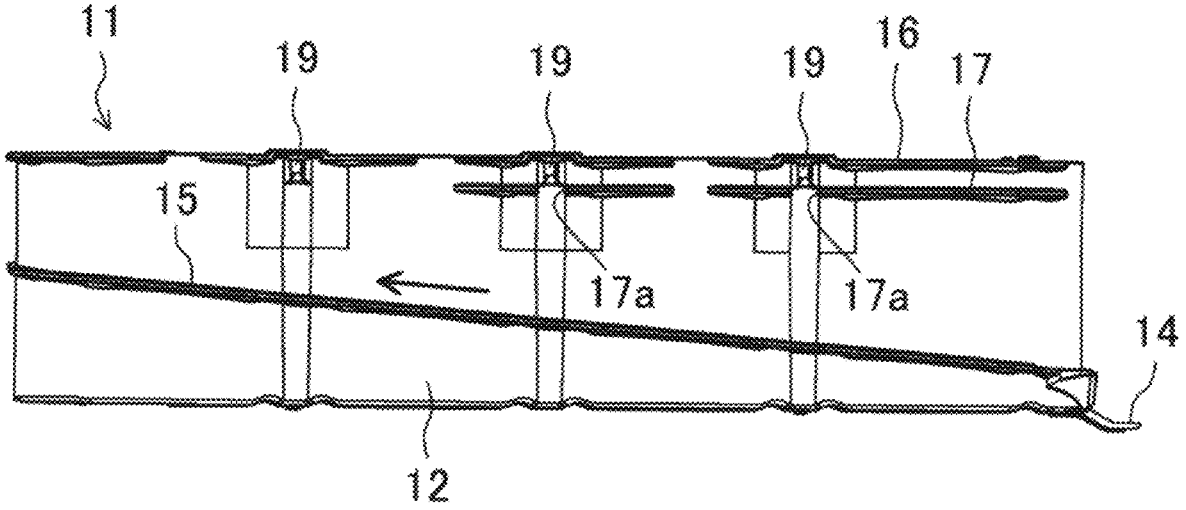
FIG. 6 is a view of the water jacket spacer when seen from the exhaust side.
Figure 7:
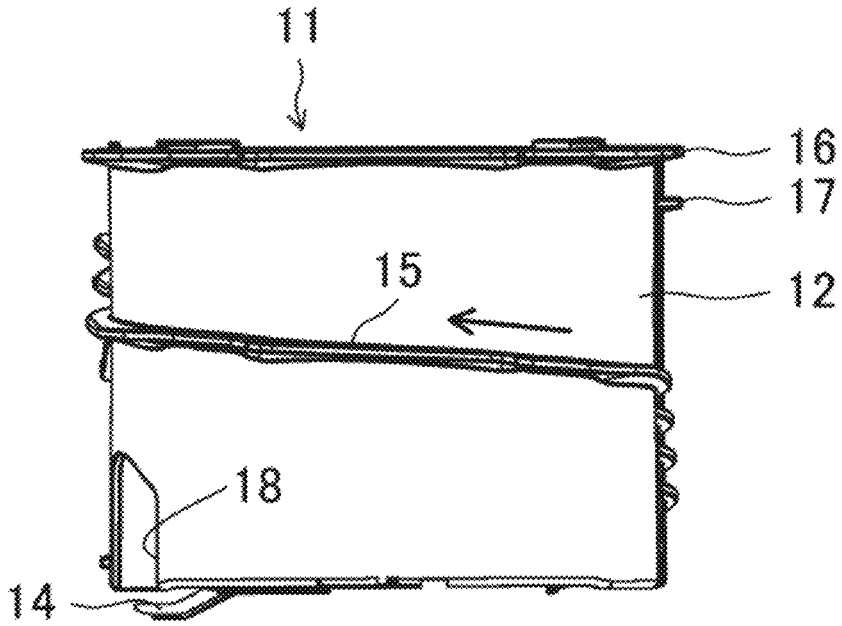
FIG. 7 is a view of the water jacket spacer when seen from the transmission side.
Figure 8:
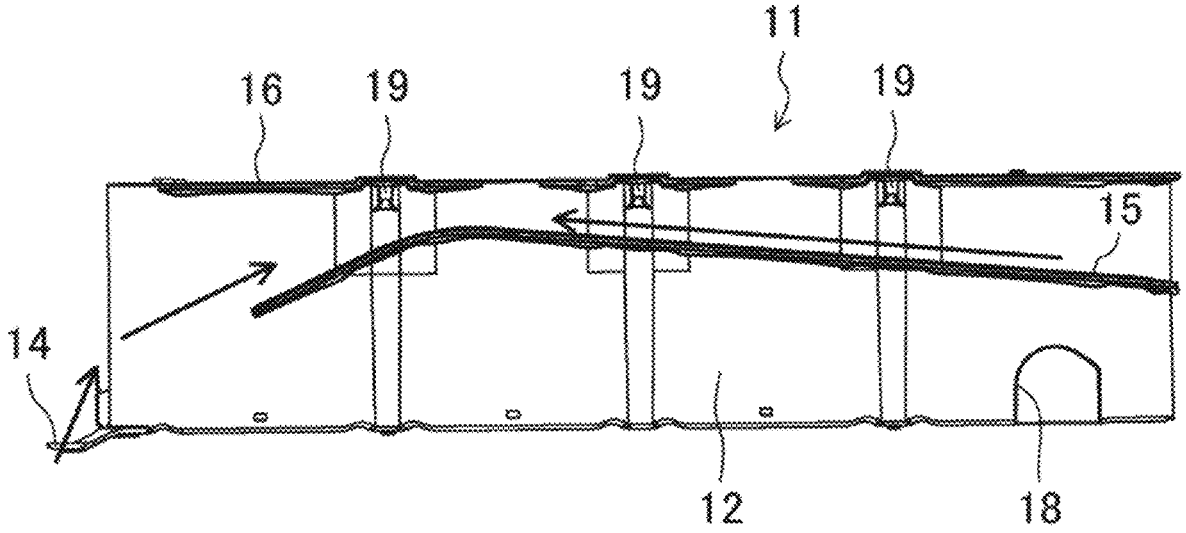
FIG. 8 is a view of the water jacket spacer when seen from the intake side.
Figure 9:
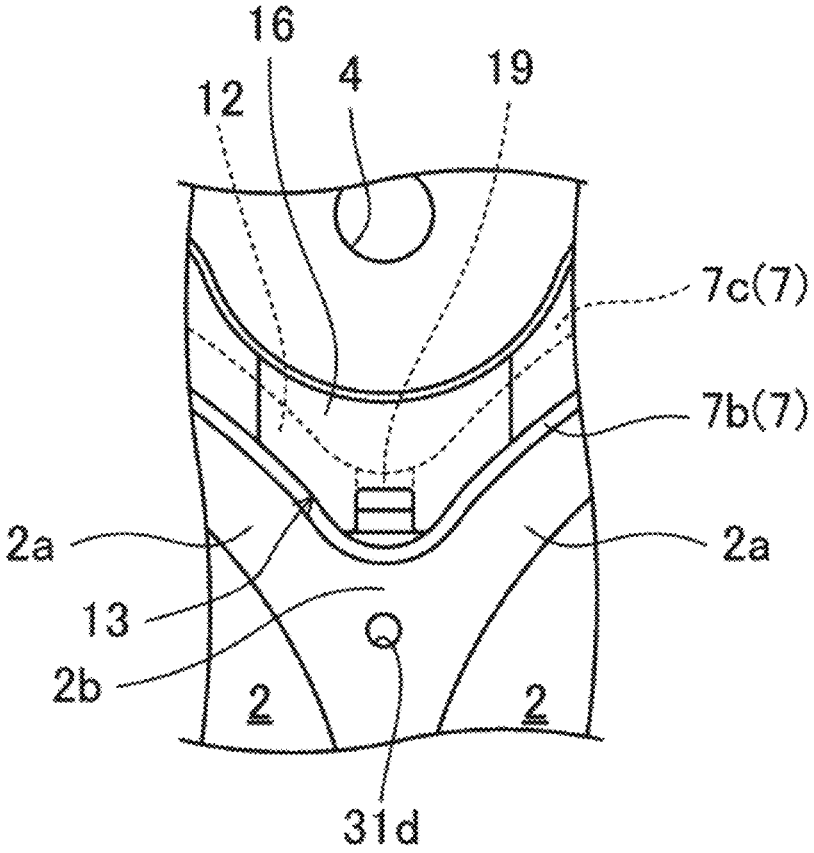
FIG. 9 is an enlarged plan view illustrating a necked part of a cylinder bore wall and an inwardly bent part of the block water jacket in an enlarged manner.

A cooling fluid guide slope 15 for lifting the cooling fluid upwardly as it goes to the downstream side of the outer channel 7*c* is formed so as to protrude from the outer surface of the peripheral wall 12 of the water jacket spacer 11 (the surface on the outer channel 7*c* side). As illustrated in FIG. 5, the cooling fluid guide slope 15 extends in the part of the peripheral wall 12 on the opposite side of the transmission, from a base-end part of the extended part 14 to the exhaust side, and then inclines upwardly to the exhaust side from an intermediate location thereof. In the part of the peripheral wall 12 on the exhaust side, as illustrated in FIG. 6, the cooling fluid guide slope 15 inclines upwardly to the transmission side so as to be continuous to the part of the peripheral wall 12 on the opposite side of the transmission. In the part of the peripheral wall 12 on the transmission side, as illustrated in FIG. 7, the cooling fluid guide slope 15 inclines upwardly to the intake side so as to be continuous to the part of the peripheral wall 12 on the exhaust side. In the part of the peripheral wall 12 on the intake side, as illustrated in FIG. 8, the cooling fluid guide slope 15 inclines upwardly to the opposite side of the transmission so as to be continuous to the part of the peripheral wall 12 on the transmission side. Note that the cooling fluid guide slope 15 in the part of the peripheral wall 12 on the intake side inclines downwardly to the opposite side of the transmission, in a section on the opposite side of the transmission from a position corresponding to the second cylinder bore 2 to the opposite side of the transmission. This is to lift upwardly the cooling fluid which flowed into the outer channel 7*c* from the cooling fluid introducing part 7*a* and which flows toward the transmission (see an arrow to the right side in FIG. 8).

The cooling fluid which substantially circled the outer channel 7*c*, and the cooling fluid which flowed into the outer channel 7*c* from the cooling fluid introducing part 7*a* and flowed toward the transmission flow into an oil cooler (not illustrated) from a cooling fluid outlet 5 (see FIG. 1) provided to a side wall surface on the intake side of the cylinder block 1.

As will be described in detail later, some of the cooling fluid which flows through the outer channel 7*c* flows into the inner channel 7*b* through six communicating holes 19 described below, and then flows from the inner channel 7*b* through six inter-bore channels 31 described below into the head water jacket 35*a*.

The cooling fluid which flowed into the head water jacket 35*a* from the inflow hole described above flows through the inside of the head water jacket 35*a* from the opposite side of the transmission to the transmission side, and then joins at an intermediate location with the cooling fluid which flowed into the head water jacket 35*a* through the inter-bore channels 31. The cooling fluid joined as described above flows outside the cylinder head 35 from an outlet provided to an end face of the cylinder head 35 on the transmission side. The cooling fluid which flowed out from the outlet and the cooling fluid which passed through the oil cooler then pass through a radiator, and are then sucked into a suction port of the water pump.

An upper flange 16 which protrudes outwardly from the peripheral wall 12 of the water jacket spacer 11 (i.e., protrudes into the outer channel 7*c*) is formed in an upper end in the outer surface of the peripheral wall 12. The upper flange 16 is formed substantially entirely in the circumferential directions of the peripheral wall 12 except for a part on the opposite side of the transmission (a part corresponding to the inflow hole). The upper flange 16 prevents the cooling fluid which flows through the outer channel 7*c* from flowing into the inner channel 7*b* beyond the upper end of the peripheral wall 12.

Moreover, as illustrated in FIGS. 5 and 6, a lower flange 17 extending in the circumferential directions of the peripheral wall 12 is formed substantially parallel to the upper flange 16, in a part of the outer surface of the peripheral wall 12 in the circumferential directions so that the lower flange 17 is separated downwardly from the upper flange 16 by a given interval. The lower flange 17 is formed in a part corresponding to the upstream side of the outer channel 7*c* in the circumferential directions of the peripheral wall 12 except for the part corresponding to the inflow hole. That is, since the cooling fluid flows vigorously upward in the upstream part of the outer channel 7*c* as described above, the double flange comprised of the upper flange 16 and the lower flange 17 prevents the cooling fluid from flowing into the inner channel 7*b* beyond the upper end of the peripheral wall 12. Note that notches 17*a* are formed in the lower flange 17 at locations immediately below the communicating holes 19 described below so that the cooling fluid flows into the communicating holes 19.

As illustrated in FIGS. 4 and 8, a notch 18 for avoiding interference with the block heater inserted into the heater plug-in hole 3 is formed in a lower part of the peripheral wall 12 on the intake side and the transmission side.

As illustrated in FIGS. 4, 6, and 8 to 11, the communicating holes 19 (in this embodiment, total of six communicating holes 19) which communicates the inner channel 7*b* with the outer channel 7*c* are formed in the peripheral wall 12 of the water jacket spacer 11 at locations corresponding to the six necked parts 2*b* of the cylinder bore wall 2*a* (i.e., the six inwardly bent parts 13), respectively. These communicating holes 19 are formed near the upper end of the peripheral wall 12 (near the end part on the cylinder head 35 side). Some of the cooling fluid which flows through the outer channel 7*c* flows into the inner channel 7*b* through the communicating holes 19.

Each communicating hole 19 is formed in a vertically-elongated rectangular shape in the cross section. That is, the vertical length of the communicating hole 19 is greater than the lateral width (the length in the cylinder line-up directions) of the communicating hole 19.

Figure 11:
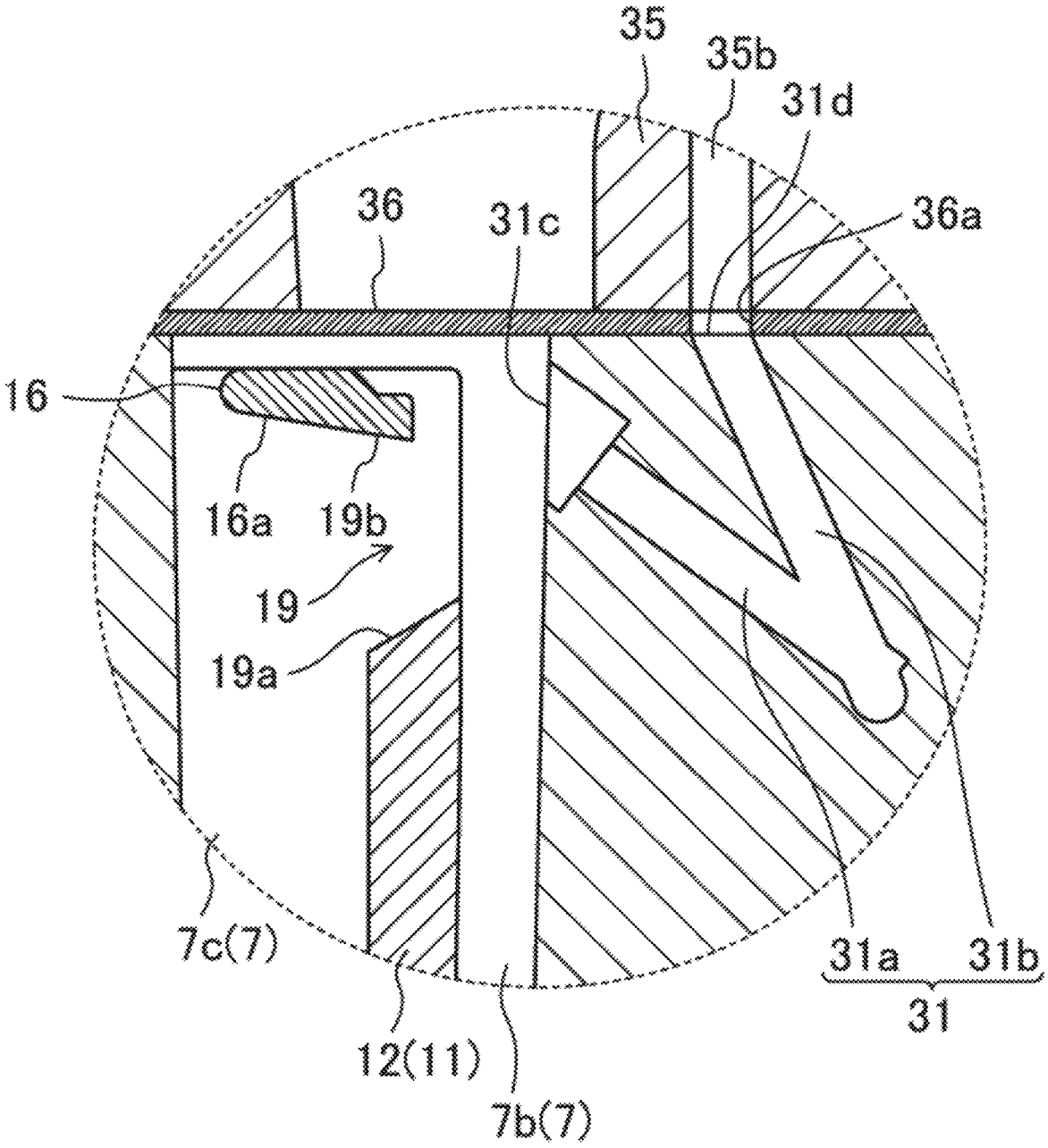
FIG. 11 is an enlarged cross-sectional view illustrating an XI part of FIG. 10.

As illustrated in FIGS. 10 and 11, the inter-bore channels 31 are provided to the necked parts 2*b* of the cylinder bore wall 2*a*, respectively.

The inter-bore channel 31 of each necked part 2*b* is comprised of an upstream channel 31*a* and a downstream channel 31*b*, and an upper end of the downstream channel 31*b* is connected to a downstream end of the upstream channel 31*a*. An upper end of the upstream channel 31*a* has a larger diameter than other parts of the upstream channel 31*a*, and opens to the inner side-wall surface of the water jacket 7. This opening of the inner side-wall surface of the upstream channel 31*a* corresponds to inlets 31*c* of the inter-bore channels 31. A downstream end of the downstream channel 31*b* opens to the upper surface of the cylinder bore wall 2*a*. This opening of the downstream channel 31*b* formed in the upper surface of the cylinder block 1 corresponds to outlets 31*d* of the inter-bore channels 31.

Both the upstream channel 31*a* and the downstream channel 31*b* extend toward the central plane and incline downwardly. The inclination angle of the upstream channel 31*a* which has a more acute angle with respect to a horizontal plane is smaller than the inclination angle of the downstream channel 31*b* which has a more acute angle with respect to a horizontal plane. Both the upstream channel 31*a* and the downstream channel 31*b* may be formed by drilling.

The downstream end of the downstream channel 31*b* (the opening in the upper surface of the cylinder block 1) is connected to the head water jacket 35*a* of the cylinder head 35 through in connecting holes 36*a* formed in the gasket 36 and connecting channels 35*b* formed in the cylinder head 35.

Each communicating hole 19 is located at the same position as an inlet 31*c* of the inter-bore channel 31 of the corresponding necked part 2*b* in the cylinder line-up directions. Thus, some of the cooling fluid which flowed into the inner channel 7*b* from the outer channel 7*c* through the corresponding communicating hole 19 flows into each inter-bore channel 31.

That is, a part of the inner circumferential surface of each communicating hole 19 in the circumferential directions inclines toward the inlet 31*c* of the corresponding inter-bore channel 31. For example, as illustrated in FIG. 11, an upper part (cylinder head side) of the inner circumferential surface of each communicating hole 19 is an upper slope 19*b* which inclines toward the inlet 31*c* of the corresponding inter-bore channel 31. The upper slope 19*b* inclines downwardly as it goes toward the inner channel 7*b*. Thus, some of the cooling fluid which flowed into the inner channel 7*b* through each communicating hole 19 flows smoothly into the inlet 31*c* of the corresponding inter-bore channel 31. Note that a slope 16*a* which inclines so as to be a flush surface with the upper slope 19*b* is formed in a part of the lower surface of the upper flange 16 located above each communicating hole 19.

In this embodiment, the lower part of the inner circumferential surface of each communicating hole 19 (opposite side of the cylinder head) is a lower slope 19*a* which inclines toward a location below the inlet 31*c* of the inter-bore channel 31. The lower slope 19*a* inclines so as to be located higher as it goes toward the inner channel 7*b*. Thus, some of the cooling fluid which flowed into the inner channel 7*b* from the outer channel 7*c* through the communicating holes 19 is assigned to the lower parts of the inlets 31*c* of the inter-bore channels 31 in the outer side surface of the cylinder bore wall 2*a* to cool the cylinder bore wall 2*a* from the outer side surface. In addition, in this embodiment, since the vertical length of each communicating hole 19 is greater than the lateral width of the communicating hole 19, the largest possible range in the necked parts 2*b* of the cylinder bore wall 2*a* in the vertical directions can be cooled. Moreover, since the lateral width of each communicating hole 19 is made smaller, a flow velocity of the cooling fluid can be increased as much as possible to make the cooling fluid vigorously hit the necked parts 2*b* of the cylinder bore wall 2*a*, but the upper slope 19*b* can cause the cooling fluid to flow more smoothly into the inlets 31*c* of the inter-bore channels 31.

The cooling fluid which flowed into the inlets 31*c* of the inter-bore channels 31 flows through the upstream channel 31*a* and the downstream channel 31*b* in this order so that it is sucked to the cylinder head 35 side. Thus, the necked parts 2*b* of the cylinder bore wall 2*a* are further cooled from the inside of the wall. Then, the cooling fluid exits from the outlets 31*d* of the inter-bore channels 31, and flows into the head water jacket 35*a* through the connecting holes 36*a* of the gasket 36 and the connecting channels 35*b* of the cylinder head 35.

Figure 12:
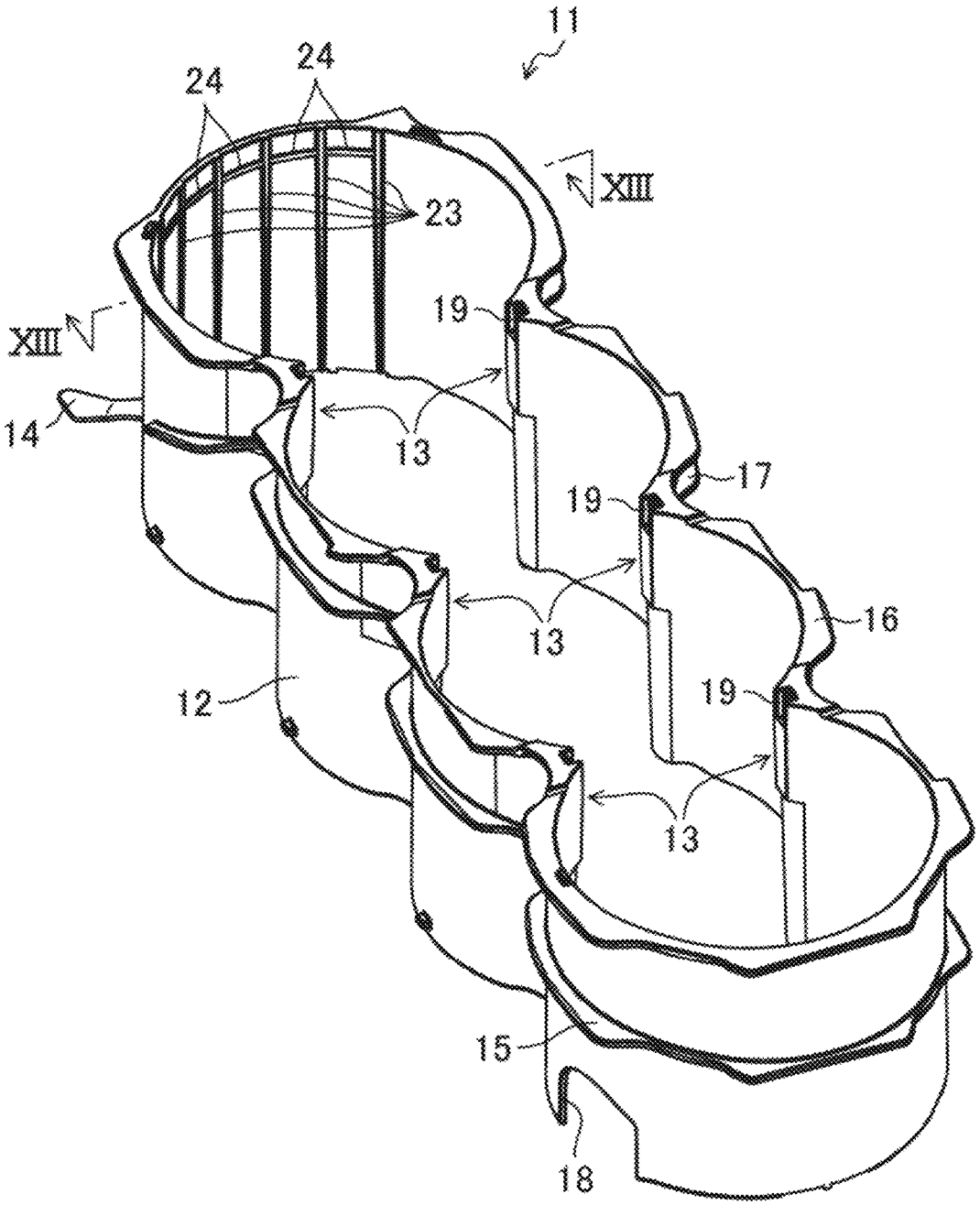
FIG. 12 is a perspective view of a peripheral wall of the water jacket spacer, seen from a direction in which vertical ribs are visible.
Figure 13:
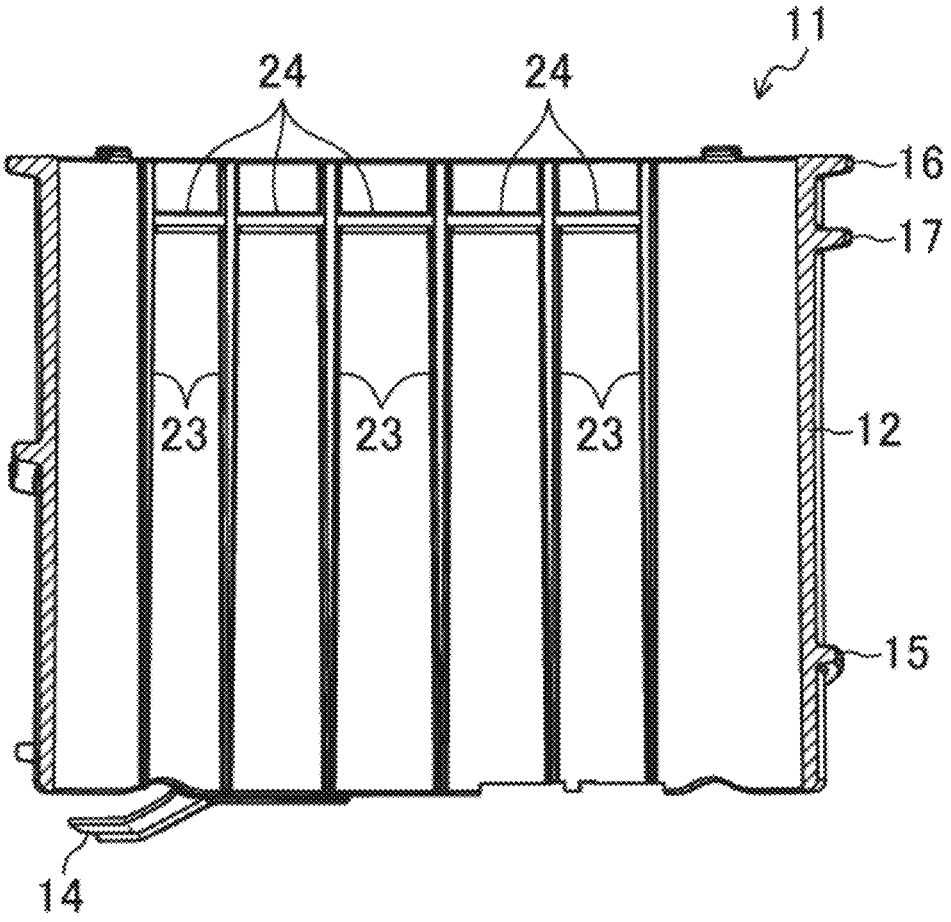
FIG. 13 is a cross-sectional view taken along a line XIII-XIII of FIG. 12.
Figure 14:
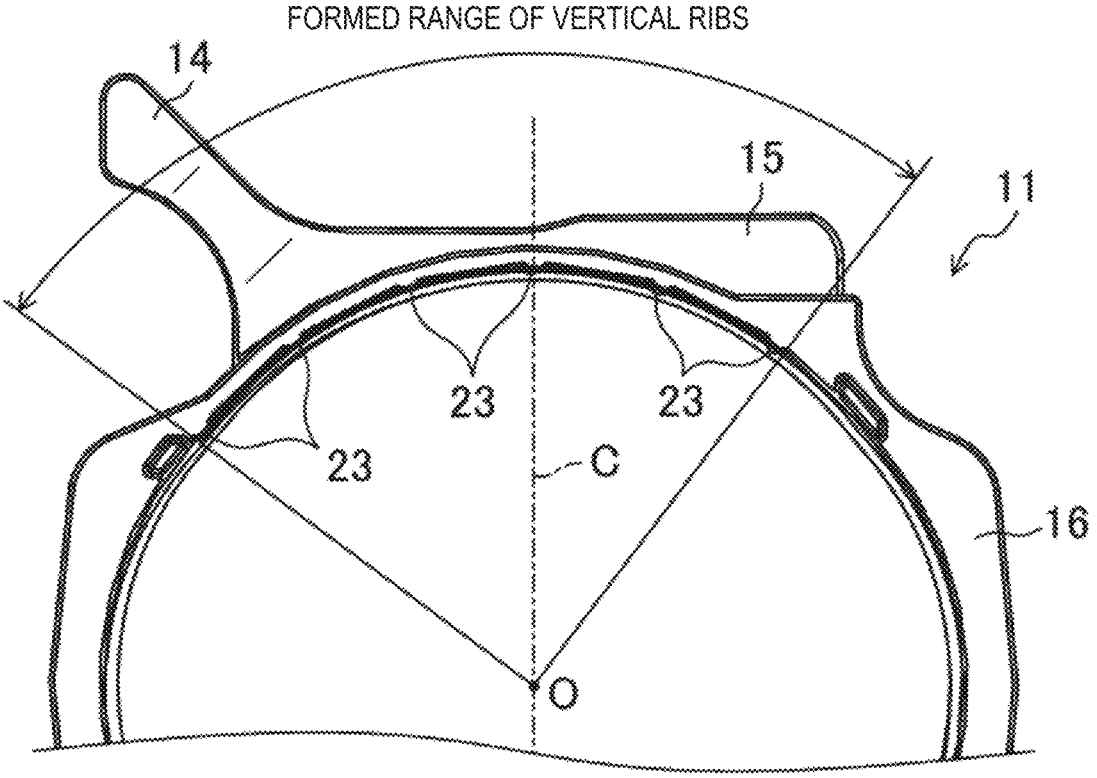
FIG. 14 is a plan view illustrating a part of the water jacket spacer on the opposite side of the transmission.

In this embodiment, as illustrated in FIGS. 12 to 14, a plurality of vertical ribs 23, which disrupts the cooling fluid flowing in the circumferential directions in the part of the inner channel 7*b* on the opposite side of the transmission (the part on the first side in the cylinder line-up directions), are formed in a part of the inner surface (the inner channel 7*b* side) of the peripheral wall 12 of the water jacket spacer 11 on the opposite side of the transmission (the part on the first side in the cylinder line-up directions) so as to be apart from each other in the circumferential directions. The vertical ribs 23 are formed entirely in the height directions of the peripheral wall 12. A width of the inner channel 7*b* in the part where the vertical ribs 23 are formed (the distance between the vertical ribs 23 and the inner side-wall surface of the water jacket 7) is less than a width of the inner channel 7*b* in the part where the vertical ribs 23 are not formed.

Adjacent vertical ribs 23 are coupled to each other with a lateral rib 24 provided in an upper part of the inner surface of the peripheral wall 12. As illustrated in FIG. 13, the interval of the adjacent vertical ribs 23 (a part below the lateral ribs 24) are larger as it goes lower (and the width of the vertical rib 23 is narrower as it goes to lower). Thus, when fabricating the water jacket spacer 11 by injection molding, it is easier to downwardly remove a mold for fabricating the vertical ribs 23 (the part below the lateral ribs 24).

As illustrated in FIG. 14, the formed range of the vertical ribs 23 is, in the plan view, a range including the base-end part of the extended part 14 (the downstream end of the cooling fluid introducing part 7*a*) in the part of the inner surface of the peripheral wall 12 on the opposite side of the transmission. The formed range of the vertical ribs 23 is, in the plan view, for example, 60° or larger and 120° or smaller as an angle about a center O of the first cylinder bore 2 from the opposite side of the transmission. Since the extended part 14 is located closer to the intake side in the part of the inner surface of the peripheral wall 12 on the opposite side of the transmission, the formed range of the vertical ribs 23 is also located closer to the intake side with respect to the central plane (represented by C in FIG. 14).

The upper flange 16 is not formed in parts corresponding to the formed range of the vertical ribs 23 in the outer surface of the peripheral wall 12 except for the two vertical ribs 23 located at both ends in the circumferential directions. Therefore, the possibility that the cooling fluid from the cooling fluid introducing part 7*a* flows into the inner channel 7*b* beyond the upper end of the peripheral wall 12 might be high. However, in this embodiment, the two vertical ribs 23 located at the both ends in the circumferential directions prevent that the cooling fluid which flowed into the inner channel 7*b* beyond the upper end of the peripheral wall 12 flows to the transmission side.

The plurality of vertical ribs 23 make the cooling fluid which did not flow into the inter-bore channels 31, of the cooling fluid which flowed into the inner channel 7*b* through the communicating holes 19 from the part of the outer channel 7*c* on the exhaust side, flow to the transmission side without flowing to the side where the vertical ribs 23 are formed (the opposite side of the transmission), similar to the cooling fluid which flows through the part of the outer channel 7*c* on the exhaust side. Note that the cooling fluid which did not flow into the inter-bore channels 31, of the cooling fluid which flowed into the inner channel 7*b* through the communicating holes 19 from the intake-side part of the outer channel 7*c*, will neither flow into the opposite side of the transmission where the vertical ribs 23 are formed, nor flow to the transmission side because of the cooling fluid flowing through the inner channel 7*b* from the exhaust side, thereby being pushed into the inter-bore channels 31.

Figure 15:
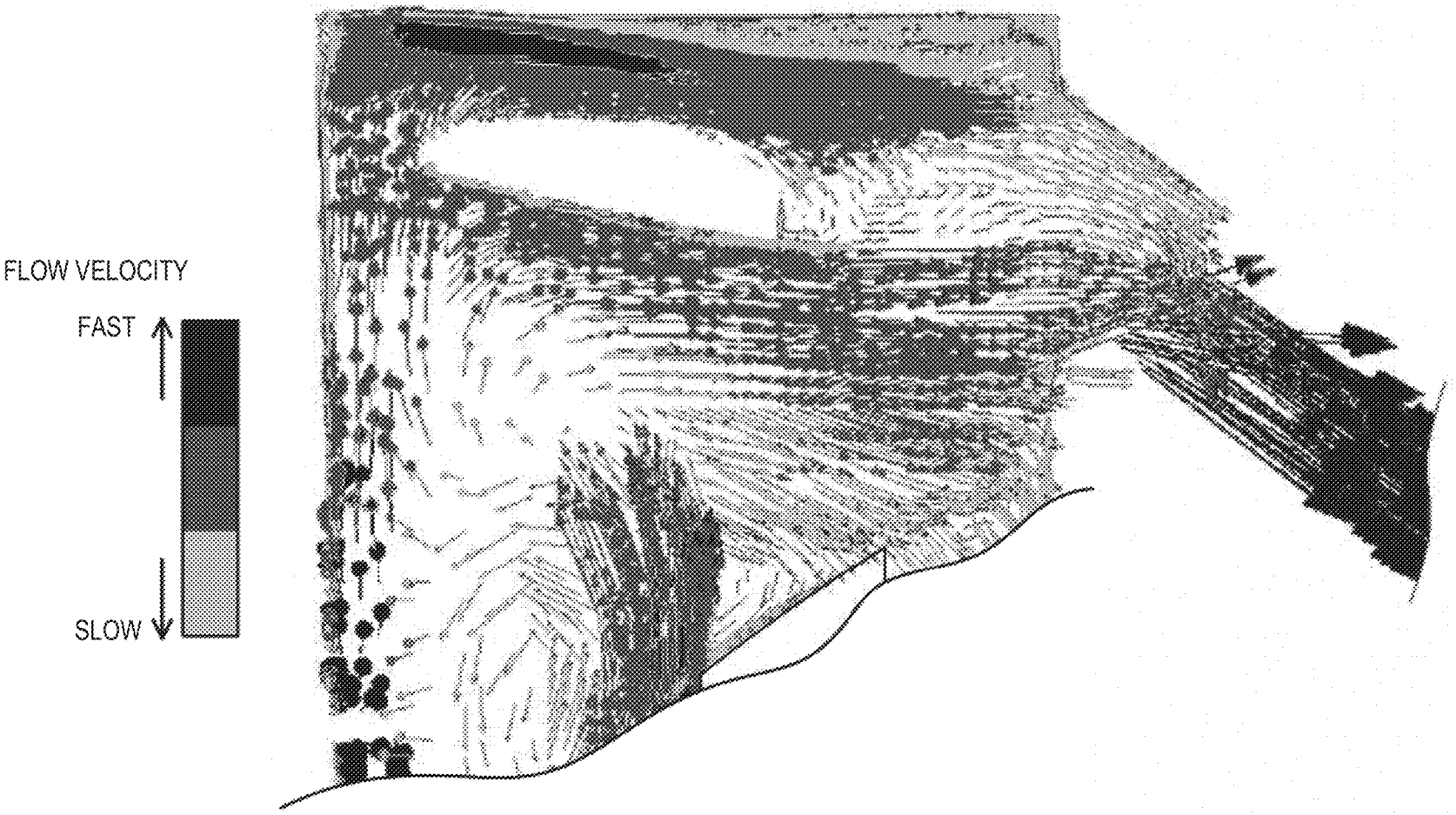
FIG. 15 is a view illustrating a result of a simulation of a flow of cooling fluid which flows into an inner channel through a communicating hole from an outer channel.

FIG. 15 illustrates a result of a simulation of a flow of the cooling fluid which flows into the inner channel 7*b* (right side of FIG. 15) through the communicating holes 19 from the outer channel 7*c* (left side of FIG. 15). The magnitude and shade or depth of a vector indicates a speed of the flow velocity so that the flow velocity is faster as the magnitude of the vector becomes larger, while the flow velocity is faster as the shade is deeper. Here, the shade is classified into three kinds so that they are easily distinguishable from each other.

From the result of the simulation, it is found that the cooling fluid which passed through the upper part of the communicating holes 19 among the cooling fluid which flowed into the inner channel 7*b* through the communicating holes 19 from the outer channel 7*c* flowed toward the inlets 31*c* (indicated on the right side of the inner channel 7*b* in FIG. 15) of the inter-bore channels 31 due to the upper slope 19*b*, and flowed into the inlets 31*c*. Since the cooling fluid which flowed into the inlets 31*c* of the inter-bore channels 31 was sucked to the cylinder head 35 side, the flow velocity became faster. Moreover, it is found that the cooling fluid which passed through the lower part of the communicating holes 19 contacted the lower part of the inlets 31*c* of the inter-bore channels 31 in the outer side surface of the cylinder bore wall 2*a*. Further, it is found that the cooling fluid which flows through the outer channel 7*c* upwardly turned smoothly to the communicating holes 19 side by the slope 16*a* (the same surface as the upper slope 19*b*) of the part of the lower surface of the upper flange 16 located above each communicating hole 19.

Therefore, in this embodiment, since the height of the peripheral wall 12 of the water jacket spacer 11 (the length in the cylinder bore axial directions) is substantially the same as the groove depth of the block water jacket 7 (the length in the cylinder bore axial directions), the inner channel 7*b* and the outer channel 7*c* are partitioned by the peripheral wall 12, thereby fundamentally communicating with each other only at the communicating holes 19. Thus, the cooling fluid flows into the outer channel 7*c* from the cooling fluid inlet 8, and this cooling fluid flows through the outer channel 7*c*. Some of the cooling fluid flows into the inner channel 7*b* through the communicating holes 19, and some of the cooling fluid which inflowed then flows into the inlets 31*c* of the inter-bore channels 31. Some of the cooling fluid which flowed into the inner channel 7*b* through the communicating holes 19 smoothly flows into the inlet 31*c* of the corresponding inter-bore channel 31 especially by the upper slope 19*b* of the inner circumferential surface of the communicating holes 19. Moreover, the cooling fluid which did not flow into the inter-bore channels 31, of the cooling fluid which flowed into the inner channel 7*b* through the communicating holes 19 from the part of the outer channel 7*c* on the exhaust side, flows toward the transmission as described above. As a result, the part of the cylinder bore wall 2*a* on the exhaust side which particularly gets hot can be cooled together with the necked parts 2*b*, thereby cooling the large area in the circumferential directions. Therefore, the cooling performance of the engine combustion chamber can be secured.

Moreover, since the width of the inner channel 7*b* is less than the width of the outer channel 7*c* which communicates with the cooling fluid inlet 8, the cooling fluid is difficult to flow inside the inner channel. Thus, the cooling fluid which flowed into the inner channel 7*b* through the communicating holes 19 but did not flow into the inter-bore channels 31 is difficult to spread vertically in the inner channel 7*b* (in the cylinder bore axial directions), the cooling fluid fundamentally flows toward the transmission substantially at the same height as the communicating holes 19. As a result, the majority of the cooling fluid inside the inner channel 7*b* is stagnated, without being mixed with fresh cooling fluid. Therefore, the heat retention performance of the engine combustion chamber can be secured by the cooling fluid in the stagnated state.

The present disclosure is not limited to the embodiment described above, and it may be substituted without departing from the subject matter of the appended claims.

For example, although in the above embodiment the upper part (cylinder head side) of the inner circumferential surface of the communicating hole 19 inclines toward the inlet 31*c* of the inter-bore channel 31 and the lower part (opposite side of the cylinder head) of the inner circumferential surface of the communicating hole 19 inclines toward the location below the inlet 31*c* of the inter-bore channel 31, the upper and lower parts of the inner circumferential surface of the communicating hole 19 may incline toward the inlet 31*c* of the inter-bore channel 31. Moreover, the communicating hole 19 may have a cone shape of which the diameter decreases toward the inner channel 7*b*, and the entire inner circumferential surface of the communicating hole 19 may incline toward the inlet 31*c* of the inter-bore channel 31.

Moreover, although in the above embodiment the engine is mounted in the vehicle so that the cylinder bore axial directions are oriented in the vertical directions, the present disclosure may also be applied to a cooling structure of the engine mounted in the vehicle so that the cylinder bore axial directions are oriented horizontally.

Moreover, although in the above embodiment the present disclosure is applied to the multi-cylinder diesel engine, the present disclosure may suitably be applied to any type of multi-cylinder compression-ignition engine.

The embodiment described above is merely illustration, and is not to be interpreted as limiting the scope of the present disclosure. The scope of the present disclosure may be defined by the appended claims, and all modifications and changes which fall within the range of equivalents of the claims are within the scope of the present disclosure.

The present disclosure is useful for the cooling structure of the multi-cylinder engine provided with the plurality of cylinder bores and the water jacket which surrounds the perimeter of the plurality of cylinder bores, the engine including the cylinder block in which the cylinder head is attached to the surface on a first side in the cylinder bore axial directions, the water jacket spacer which is accommodated in the water jacket of the cylinder block and having the peripheral wall formed corresponding to the plurality of cylinder bores. The present disclosure is particularly useful when the multi-cylinder engine is the compression-ignition engine, such as the diesel engine.

DESCRIPTION OF REFERENCE CHARACTERS

1 Cylinder Block
2 Cylinder Bore
7 Block Water Jacket
7*b* Inner Channel
7*c* Outer Channel
8 Cooling Fluid Inlet
11 Water Jacket Spacer
12 Peripheral Wall
19 Communicating Hole
19*a* Lower Slope
19*b* Upper Slope
23 Vertical Rib
35 Cylinder Head

What is claimed is:

1. A cooling structure of a multi-cylinder engine having a cylinder block, comprising:

a plurality of cylinder bores formed in the cylinder block;

a water jacket surrounding the plurality of cylinder bores;

a cylinder head; and a water jacket spacer accommodated in the water jacket of the cylinder block and having a peripheral wall formed to correspond to the plurality of cylinder bores, wherein a length of the peripheral wall in cylinder bore axial directions is substantially the same as a length of the water jacket in the cylinder bore axial directions, wherein the peripheral wall forms, inside the water jacket, an inner channel located inside the peripheral wall and an outer channel located outside the peripheral wall, wherein a width of the inner channel is less than a width of the outer channel, wherein communicating holes communicating the inner channel with the outer channel are formed in the peripheral wall at locations between adjacent cylinder bores, respectively, wherein inter-bore channels into which some of cooling fluid flowing from the outer channel into the inner channel through the communicating holes flows are provided to parts of the cylinder block between the adjacent cylinder bores, respectively, wherein at least a part of an inner circumferential surface of each communicating hole in circumferential directions inclines at an inclination of greater than zero to tilt toward an inlet of a corresponding one of the inter-bore channels, wherein the inlet of the corresponding one of the inter-bore channels is provided at a side surface of the inner channel within the cylinder block, and wherein an upper flange, protruding outwardly from an upper end of the peripheral wall, is formed with a lower surface inclining at an inclination of less than zero to tilt toward the inlet of the corresponding one of the inter-bore channels.

2. The cooling structure of claim 1, wherein a part of the inner circumferential surface of each communicating hole on a cylinder head side inclines at an inclination of greater than zero to tilt toward the inlet of the corresponding inter-bore channel, and wherein a part of the inner circumferential surface of each communicating hole on an opposite side of the cylinder head inclines at an inclination of greater than zero to tilt toward a location below the inlet of the corresponding inter-bore channel.

3. The cooling structure of claim 1, wherein a cooling fluid inlet communicating with the outer channel is provided to the cylinder block, the cooling fluid flowing into the outer channel through the cooling fluid inlet.

4. The cooling structure of claim 3, wherein the multi-cylinder engine is an in-series multi-cylinder engine, wherein the cooling fluid inlet communicates with a part of the outer channel on a first side in cylinder line-up directions, wherein the cooling fluid flowing into the outer channel from the cooling fluid inlet and flowing through the outer channel flows along a route sequentially from the part of the outer channel on the first side, through a part on an exhaust side and a part on a second side in the cylinder line-up directions, and into a part on an intake side, and wherein a rib configured to disrupt the cooling fluid flowing in the circumferential directions in the part of the inner channel on the first side is formed in the part of an inner-channel-side surface of the peripheral wall on the first side.

* * * * *